United States Patent [19]

Forrest

[11] 4,059,268

[45] Nov. 22, 1977

[54] AGILITY RUNNING OBSTACLE DEVICE

[76] Inventor: Charles P. Forrest, 1306 St. Stephens Road, Mobile, Ala. 36603

[21] Appl. No.: 795,500

[22] Filed: May 10, 1977

[51] Int. Cl.[2] ..... A63B 67/00

[52] U.S. Cl. ..... 273/55 R

[58] Field of Search ..... 273/55 R, 194; 272/65, 272/70, 100

[56] References Cited

U.S. PATENT DOCUMENTS

| | | | |
|---|---|---|---|
| 2,354,050 | 7/1944 | Paupa | 272/100 X |
| 3,255,115 | 6/1966 | Peterson | 272/70 X |
| 3,433,480 | 3/1969 | Coleman et al. | 273/55 R |
| 3,578,323 | 5/1971 | Coleman | 273/55 R |
| 3,672,672 | 6/1972 | Rubin | 273/55 R X |

*Primary Examiner*—Richard C. Pinkham
*Assistant Examiner*—T. Brown
*Attorney, Agent, or Firm*—Cameron, Kerkam, Sutton, Stowell & Stowell

[57] ABSTRACT

A portable running rope device for practicing running an obstacle course having a supporting framework for supporting a plurality of criss-crossing ropes forming a latticework of running ropes which define spaces in which a runner is to place his feet during use. The framework includes a plurality of cross members with flexible ends to support the latticework of running ropes where the flexible ends yield to prevent injury in case the runner trips during practice.

7 Claims, 7 Drawing Figures

AGILITY RUNNING OBSTACLE DEVICE

BACKGROUND OF THE INVENTION

The present invention relates to a device for practicing running and, more particularly, to a portable running device with defined places in which a runner places his feet without the danger of injury from accidental tripping.

In teaching football it is necessary for players to practice running with both eye and foot coordination to make the runner more agile. An exercise which has proven to be especially beneficial in playing the game of football where broken field running is needed to elude potential tacklers is running through a course of running ropes.

Prior methods for practicing running consisted of laying down a number of old automobile tires along a course where the athlete would attempt to place his feet only within the tires as he proceeded along the course. Because this arrangement was rather cumbersome and required a large number of separate elements, it was eventually replaced by a suitable integral structure of elevated ropes either staked out in a semipermanent arrangement or on a portable framework. While these devices had generally been accepted by coaches and teachers, they have proven to be dangerous to the players using them. All running rope courses, no matter what type, requires careful placement of the players' feet, otherwise, he is liable to be tripped or become entangled in the ropes causing him to fall on the supporting framework with a possible resulting injury. There is a portable running rope device which uses a resilient means to avoid such injury where springs are attached between each rope and the support framework. This device has worked with some limited success however, the device requires a substantial framework including parallel bars on each side of the running ropes, therefore, should a runner fall during practice a real danger of injury exists from striking one of these bars.

SUMMARY OF THE INVENTION

It is a primary object of the present invention to provide a fully portable running rope device of the type described, thereby overcoming the foregoing shortcomings of the prior art devices.

It is an object of the present invention to provide a portable running rope device for practice running which incorporates a rigid frame and a lattice work of running ropes mounted on the frame to define the running course.

It is another object of the present invention to provide a running rope device of the type described which is exceptionally safe to be used by all groups and ages of runners.

It is a further object of the present invention to provide a running rope device which is easily transferred from one position to another in an assembled condition and yet is stable in position for use.

It is another object of the present invention to provide a portable, lightweight running rope device which is easily stored and transported, but is also ruggedly constructed for rough use.

It is a further object of the present invention to provide a running rope device where the lattice work of running ropes will yield in any direction to prevent injury.

It is a further object of the present invention to provide a running rope device of relatively simple construction for ease and economy of manufacture of the same.

It is also an object of the present invention to provide a running rope device which utilizes a stable framework without parallel bars on each side of the running ropes.

According to the invention, there is provided a framework defining a practice running rope device with a latticework of running ropes supported by the framework so as to designate the spaces in which a runner is to place his feet during use of the device. Preferably, the framework comprises a plurality of generally U-shaped cross members which are spaced apart longitudinally and held together by a plurality of longitudinal bars. The U-shaped cross members have a ground engaging center section and upstanding ends. Flexible elements are connected to the upstanding ends of the cross members. It will be realized that a running rope device of this construction can be easily transferred from one position on a practice field to another since it is lightweight and can be easily slid on the cross members across the ground by a single person. The framework of this invention is made in sections to make the running rope device easier to disassemble to transport over long distances and easier to store when not in use.

Furthermore, the running ropes which define the spaces of the portable running rope device of the preferred embodiment of this invention are non-stretchable and are attached to the flexible elements on the framework to permit flexure of the same upon contact with the runner so as to prevent tripping of the runner should he catch his foot on one of the cross ropes. In addition, if a runner is tripped and falls during running practice with the device, the flexible elements allow the running ropes to yield in any direction thereby avoiding possible injury to the runner. The framework has been designed to prevent injury to the runner if he should fall on it, and at the same time has proven to have required stability in the set position.

DESCRIPTION OF THE DRAWINGS

Other objects and advantages of this invention will become apparent from the following detailed description thereof and the accompanying drawings wherein.

DESCRIPTION OF THE PREFERRED EMBODIMENT

Figure 1:
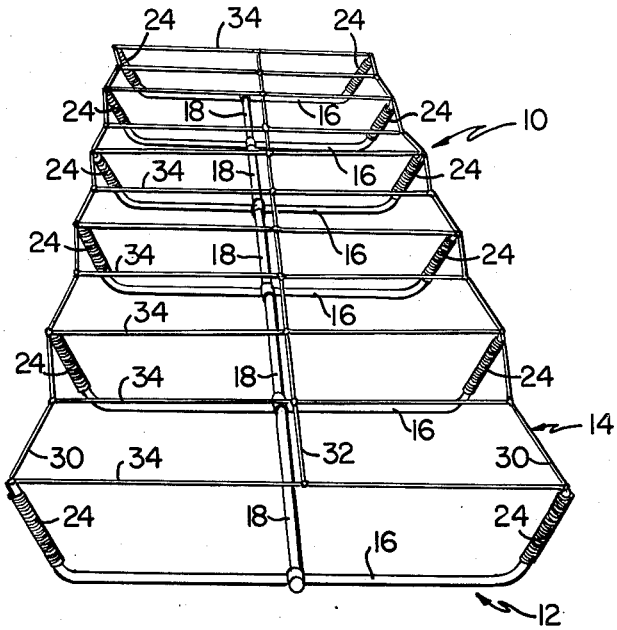
FIG. 1 is a perspective view of a running rope device embodying the invention.
Figure 2:
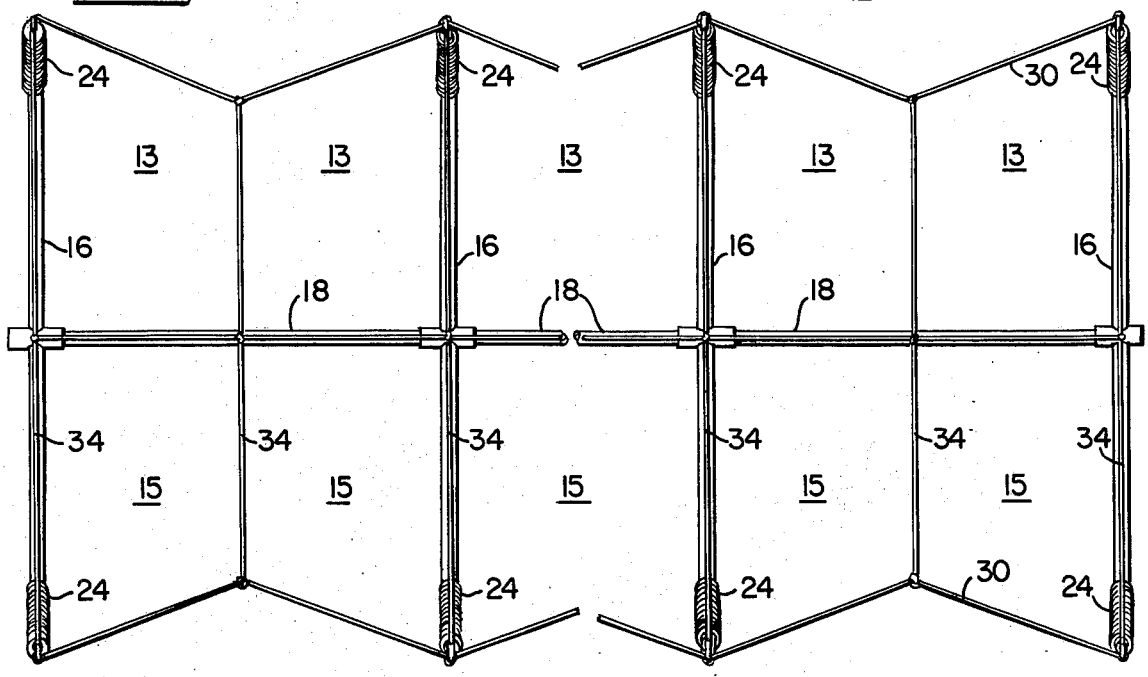
FIG. 2 is a top plan view of the running rope device embodying the invention.
Figure 3:
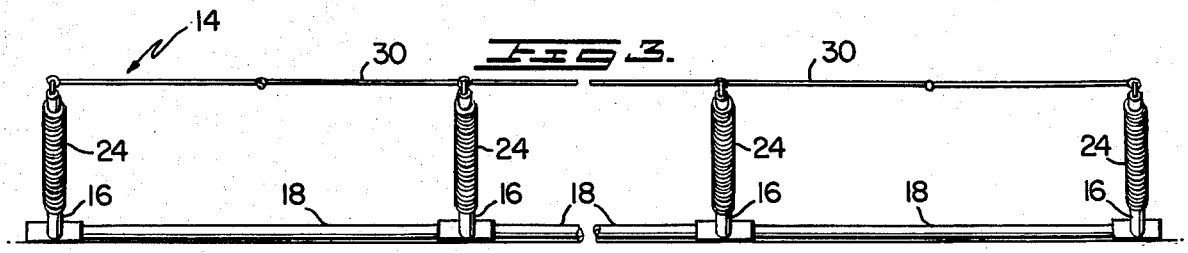
FIG. 3 is a side elevation view of the running rope device of FIG. 2.

Referring now to the drawings, and in particular to FIG. 1, there is shown a running rope device generally designated by the reference numeral 10 which includes a framework 12 and a latticework 14 of non-stretchable running ropes defining a series of right and left hand spaces 13 and 15 (FIG. 2). As mentioned above, the intended use of the running rope device 10 is for running practice by a runner or player, who proceeds along the course of the running rope device 10 by placing his feet in the designated spaces 13, 15 in a well known high stepping fashion to clear the latticework 14. It is apparent that this running exercise is effective to improve the coordination, and thus the agility, of the player; and after practice with the running rope device 10, the coordinated movement of the runner with the placement of his feet in the spaces 13, 15 in the proper manner becomes more and more automatic, as desired.

The framework is constructed of a series of U-shaped cross members 16 spaced apart by longitudinal center bars 18. Each U-shaped cross member 16 has a center portion 20 (FIGS. 4 and 5) adapted to rest on the ground so as to support the entire framework 12 above the ground, and a pair of outwardly inclined upstanding legs 22. It should be noted that the framework 12 is most efficiently constructed from suitable sized metal pipe or tubing, as shown, although it is to be understood that any equivalent construction may be used if desired.

As shown, the legs 22 extend upwardly at an angle less than 90° with respect to the center portion 20 of the U-shaped cross member 16. Since the framework 10 has a low center of gravity by having the legs 22 extend outwardly, should a player happen to trip and fall, the running rope device 10 is capable of a slight tipping action to absorb the blow and return to the original set position.

Figure 4:
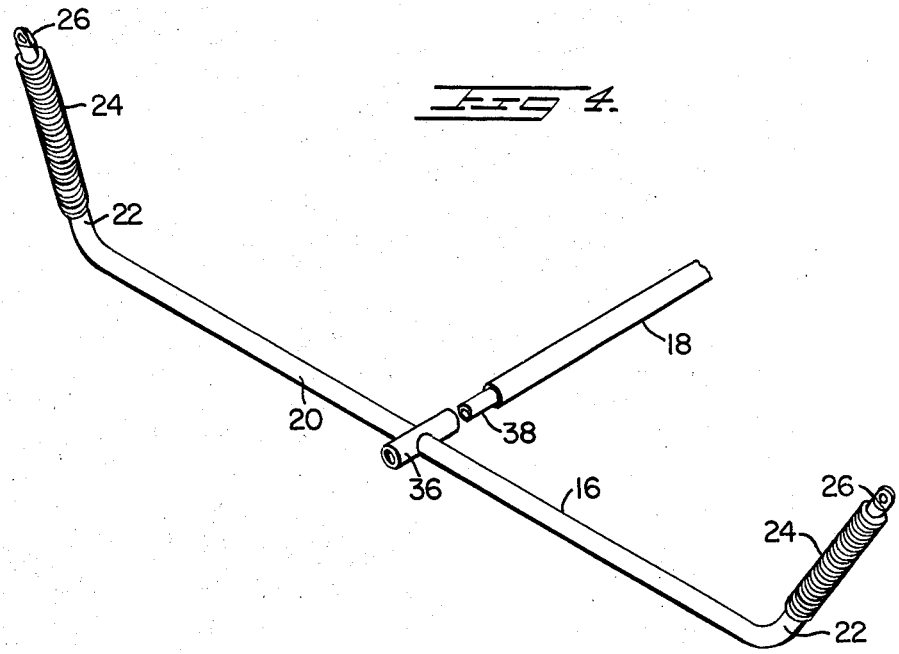
FIG. 4 is a perspective view of one of the U-shaped cross members of the running rope device embodying the invention.
Figure 5:
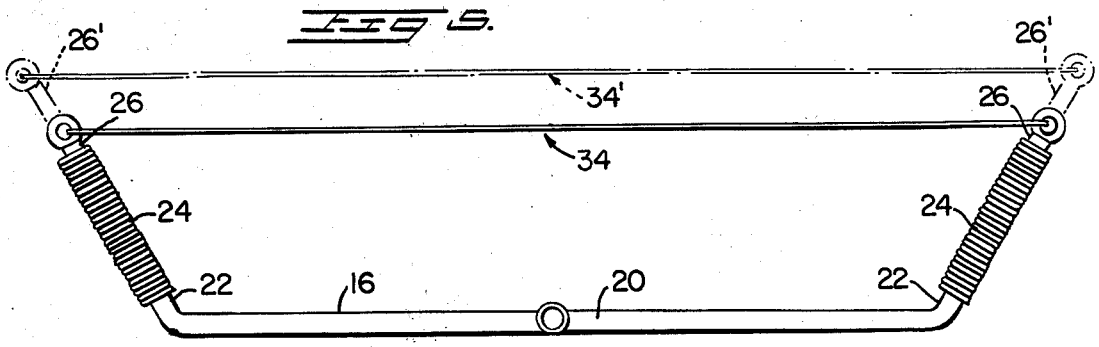
FIG. 5 is an end elevation view of the running rope device of FIG. 1.
Figure 6:
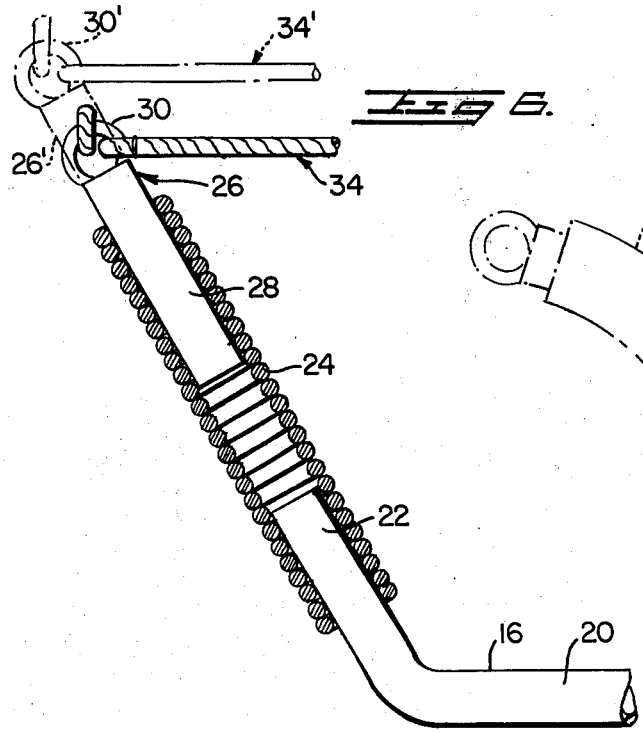
FIG. 6 is an elevation view, partially in section, of the upright portion of one of the cross members of the portable running rope device of FIGS. 1–3; and, FIG. 7 is an elevation view of the structure of FIG. 6 illustrating the flexing of the upright portion of the cross member.

Extending from the legs 22 of the U-shaped cross members 16 are coiled spring elements 24, best shown in FIGS. 4–6. The spring elements 24 frictionally engage the legs 22 of the cross members 16 and project upwardly and outwardly at the same angle as the legs 22.

A plurality of rope connectors 26, each consisting of a cylindrical body 28 which telescopes within the spring element 24 and an eyelet 30 which is connected to one of the running ropes of the latticework 14, elevates or lowers the height of the running ropes according to the needs of a runner (FIG. 6). The height of the running ropes is adjusted by moving the rope connectors 26 up and down within the spring elements 24, as shown in FIGS. 5 and 6 by phantom lines 26' and 14'. It is obvious that the height adjustment of the running ropes is limited only by the length of the body portions 28 of the rope connectors 26; therefore, when it is necessary for a runner to practice raising his legs high it may be desirable to use rope connectors with extra long body portions.

The latticework 14 of running ropes shown in FIGS. 1 and 2 also includes a pair of longitudinally extending outside lines 30, a center line 32 and an array of criss-crossing lines 34. The center line 32 is preferably connected to each of the criss-crossing lines 34 to maintain the spaces 13 and 15 of substantially equal size and is solely supported by the criss-cross lines 34. Alternate criss-cross lines 34 are connected directly to the outside lines 30 while the remaining criss-cross lines connect to the eyelets of the rope connector 26.

The running rope lines may be suitably formed of any relatively lightweight, non-stretchable rope available; however, it has been found that nylon rope is particularly adapted for efficient use with the running rope device 10, since it is more rugged and resistant to wear.

As shown in FIG. 4, each U-shaped cross-member 16 has a hollow tubular sleeve connecting element 36 located midway between the ends of the center portion 20. The sleeve connecting element 36 traverses the center portion 20 of U-shaped cross-member 16 to frictionally receive the ends 38 of two longitudinal center bars 18, one of which is shown in FIG. 4 detached from the U-shaped cross member 16. The end 38 of the transverse center bar 18 is necked down to have the substantially same diameter as the inside diameter of the hollow tubular sleeve connecting element 36. By this connecting arrangement a plurality of U-shaped cross members may be joined together by the longitudinal center bars in a short period of time. Once the framework assembly 10 is completed, tension is applied to the assembly by the latticework 14 of running ropes to hold it together.

Figure 7:
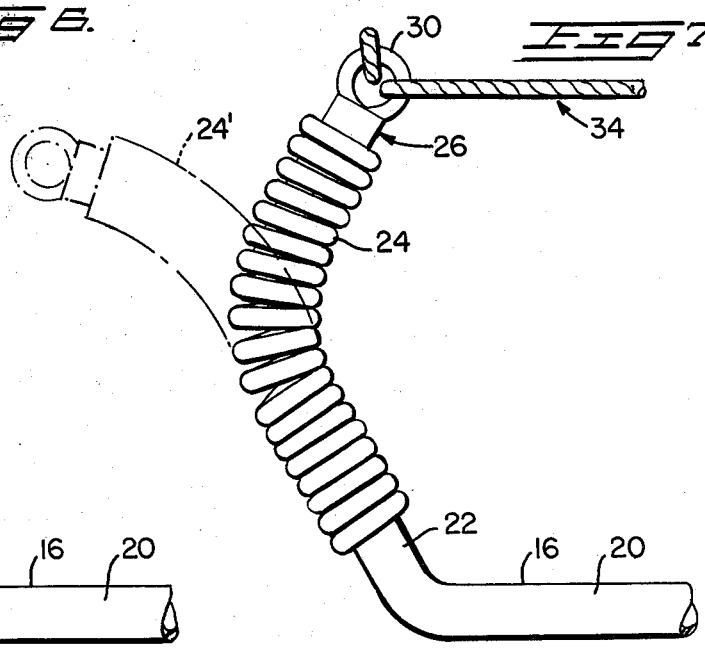

The latticework of running ropes is held taut by the spring elements 24 mounted on the legs 22 of the U-shaped cross members, resulting in a working relationship between the latticework of running ropes and the spring elements 24. Should a runner trip on one of the criss-cross ropes 34 the spring elements 24 are designed to flex in the direction of the force applied to the running rope, causing the latticework to yield. This is more clearly shown in FIG. 7 by the solid and phantom lines which indicate the movement of the rope 34 and the spring element 24 as a result of a runner tripping on a criss-cross rope or one of the outside ropes. Furthermore, if a runner happens to step directly on lines 32 and 34, serious injury would be avoided since the spring elements 24 will flex sufficiently to allow the runner's feet to touch the ground in the normal manner. Likewise, should a runner trip and fall sideways, the spring elements 24 provide an important safety feature of being capable of flexing sufficiently to prevent injury to the runner who may fall on them.

In accordance with another important aspect of the present invention, the running rope device 10 is formed in sections for ease of storage and transfer. Thus, sections of U-shaped cross members 16, as shown in FIG. 4, are assembled by sliding the necked down ends 38 of longitudinal center bars 18 into connecting sleeves 36 and attaching the latticework 14 of running ropes to the eyelets 30 of connectors 26. The latticework of running ropes and the rope connectors 26 are preassembled; consequently, when the framework 10 is assembled the latticework of running ropes is joined to the framework by inserting the bodies 28 of the rope connectors 26 into the springs 24. Disassembly of the running rope device is accomplished by reversing the steps.

While the preferred embodiment is directed to the use of coil springs, it is contemplated that other yieldable resilient structures could also be used, as for example, rubber or plastic structures having an elastic memory. The essential requirement of the springs is that they yield in the direction of force when a runner trips on a criss-cross rope, therefore, any spring which meets this requirement will work equally well.

Although only one specific form of running rope device has been described and illustrated in the drawings, it will be understood that various modifications and changes may be made by those skilled in the art without departing from the inventive concept. Reference should therefore be had to the appended claims for a definition of the scope of the invention.

What is claimed is:

1. A portable running rope device for use by a runner to practice running on a generally flat surface comprising an elongated framework including a plurality of U-shaped cross members each having a ground engaging center portion and a pair of outwardly inclined upstanding legs, a coil spring connected to and projecting upwardly from each of said upstanding legs and capable of flexing in the direction of an applied force, a plurality of longitudinally extending center bars connecting the U-shaped cross members together in a spaced relationship and a latticework of running ropes attached to the upper ends of said coil springs.

2. The portable running rope device as claimed in claim 1 wherein said upstanding legs of the U-shaped cross members are bent outwardly at an angle less than 90° to the center portion of the U-shaped cross members.

3. The portable running rope device as claimed in claim 2 wherein said latticework of running ropes includes a pair of longitudinally extending outside ropes, a longitudinally extending center rope, and a plurality of criss-cross ropes attached to both said center rope and said outside ropes.

4. The portable running rope device as claimed in claim 3 including connecting members for removably attaching said outside ropes to the upper ends of said coil springs.

5. The portable running rope device as claimed in claim 4 wherein said connecting members telescopically engage the upper ends of said coil springs so as to elevate or lower said latticework of running ropes.

6. The portable running rope device as claimed in claim 5 wherein each of said connecting members includes an eyelet for attaching said latticework of running ropes and a cylindrical body telescopically engaging one of said coil springs.

7. The portable running rope device as claimed in claim 1 wherein the ground engaging center portion of each of said U-shaped cross members includes a transverse sleeve, and each of said center bars includes at least one necked-down end of substantially the same outside diameter as the inside diameter of the transverse sleeve, whereby said framework may be assembled by inserting the necked-down ends of said center bars in the transverse sleeves of said cross members.

* * * * *